US008387432B2

(12) United States Patent
Ross et al.

(10) Patent No.: US 8,387,432 B2
(45) Date of Patent: Mar. 5, 2013

(54) METHOD AND APPARATUS FOR DISPENSING SHEETS OF FOIL

(75) Inventors: Gary Ross, Monmouth (GB); Andrew Nancollis, Somerset (GB)

(73) Assignee: Procare UK Limited, Bristol (GB)

( * ) Notice: Subject to any disclaimer, the term of this patent is extended or adjusted under 35 U.S.C. 154(b) by 910 days.

(21) Appl. No.: 12/296,124

(22) PCT Filed: Mar. 30, 2007

(86) PCT No.: PCT/GB2007/001164

§ 371 (c)(1),
(2), (4) Date: Jul. 7, 2009

(87) PCT Pub. No.: WO2007/113506

PCT Pub. Date: Oct. 11, 2007

(65) Prior Publication Data

US 2009/0277919 A1 Nov. 12, 2009

(30) Foreign Application Priority Data

Apr. 6, 2006 (GB) ..... 0607006.4

(51) Int. Cl.
*B21D 13/00* (2006.01)
*B21D 28/00* (2006.01)

(52) U.S. Cl. ..... 72/185; 72/338

(58) Field of Classification Search ..... 72/185, 72/203, 294, 307, 325, 338, 341; 221/1, 221/30; 493/356
See application file for complete search history.

(56) References Cited

U.S. PATENT DOCUMENTS

| | | | | |
|---|---|---|---|---|
| 6,237,608 | B1 | 5/2001 | Kari | |
| 6,602,177 | B2 * | 8/2003 | Muir | 493/424 |
| 2002/0003157 | A1 | 1/2002 | Muir | |

FOREIGN PATENT DOCUMENTS

| | | | |
|---|---|---|---|
| EP | 1 329 406 | A | 7/2003 |
| WO | 2003/062110 | A | 7/2003 |
| WO | 2004/069711 | A | 8/2004 |

* cited by examiner

*Primary Examiner* — Teresa M Ekiert
(74) *Attorney, Agent, or Firm* — Cohen & Grigsby, P.C.

(57) ABSTRACT

A dispenser for dispensing folded sheets (160) of foil comprises first advancement means (119, 121) for controllably advancing a strip (161) of foil in a feed direction (F); folding means (147, 135, 139, 129) for folding a leading edge of said strip of foil (161); cutting means (141, 133) for cutting said strip (161) of foil to form a sheet (160) of foil; second advancement means (123, 125) for flattening the fold formed in the leading edge of said sheet (160) of foil and dispensing said folded sheet (160) of foil.

8 Claims, 8 Drawing Sheets

METHOD AND APPARATUS FOR DISPENSING SHEETS OF FOIL

FIELD OF THE INVENTION

The present invention relates to method and apparatus for dispensing sheets of foil in which an edge of the sheet is folded. In particular, but not exclusively, it relates to method and apparatus for automatically dispensing sheets of foil ready for use in colouring hair.

BACKGROUND OF THE INVENTION

Devices for dispensing sheets of material from a roll are well known. In their simplest form the free end of the material is grasped and pulled manually. Once the required amount of material has been pulled free of the roll, the strip of material is torn on a serrated edge of the packaging containing the roll of material to form a sheet as required. Dispensers for semi-automatically dispensing a predetermined length of material are also known in which a motor drives rollers for advancing a sheet of predetermined length of material which can be manually torn on a serrated edge of the dispenser.

Using sheets of aluminium foil in colouring (highlighting) hair is well known. The process requires the hairdresser to pick up a pre-cut sheet of foil with one hand whilst holding the prepared section of hair with the other. The hairdresser must then fold the upper edge of the sheet whilst holding the prepared section of hair. This folded edge forms a solid edge to fit tightly under the roots of the prepared section of hair. The prepared section of hair lies on the sheet separated from the rest of the hair and the colour is brushed onto the prepared section of hair. The folded edge is important as it provides a tight fit to the roots of the coloured hair to avoid the colour "bleeding". The process requires many sheets of foil which have to be pre-cut before the colouring process. Depending on the length of the hair to be coloured, different lengths of foils may be required.

Invariably, salons store the foils in pre-cut format which is inconvenient as the foil can become easily damaged or creased making them unsuitable for their purpose. In the manual and semi-automatic dispensers mentioned above, many sheets of foil have to be prepared before the colouring process and it is not possible for the hairdresser to predict the exact number of foils required for a particular treatment and therefore, inconveniently, the hairdresser may have too few or too many sheets of foil.

Further, such prior art dispensers do not provide completely prepared sheets of foil in that one edge of the sheet is not folded to provide the edge required for the roots of the hair. Therefore, in using such dispensers, the hairdresser is still required to fold the edge whilst holding the prepared section of hair which can be cumbersome as well as time consuming.

U.S. Pat. No. 6,602,177 provides a solution by providing a dispenser for automatically producing sheets of foil for hair colouring in which one edge is folded. The dispenser operates such that a strip of foil is fed from a roll by two pairs of nip rollers. A cutter and folding assembly is provided between the pairs of nip rollers. Firstly a sheet of foil is cut from the strip and the trailing edge of the sheet is folded by firstly pressing the edge into a vertical V-shape and folding down the upper edge of the V-shaped edge with a resilient roller and a knock-down table. The cut and folded sheet is then dispensed through the downstream pair of nip rollers. As the fold is formed in the trailing edge, the downstream nip rollers catch the fold, which can crease the fold further forming a multi-layered fold, and due to the bulk of the fold, the dispenser is inclined to jam. Alternatively the downstream nip rollers cause the fold to unfold. Furthermore the folding assembly comprises a press to form the V-shaped edge and a roller to crease and form the fold making the dispenser complex in design.

SUMMARY OF THE INVENTION

The present invention seeks to provide a dispenser of sheets of foil having a folded edge in which the fold is form in line with the movement of the dispensing mechanism to prevent the device becoming jammed and to maintain integrity of the fold. It also seeks to provide a simplified mechanism for shaping and forming the fold.

This is achieved according to an aspect of the present invention by apparatus for dispensing folded sheets of foil, the apparatus comprising: first advancement means for controllably advancing a strip of foil in a feed direction; folding means for folding a leading edge of the strip of foil; cutting means for cutting the strip of foil to form a sheet of foil; second advancement means for flattening the fold formed in the leading edge of the sheet of foil and dispensing the folded sheet of foil.

This is also achieved according to another aspect of the present invention by a method for dispensing sheets of folded foil, the method comprising the steps of: advancing a strip of foil in a feed direction; folding a leading edge of the strip of foil; cutting the strip of foil to form a sheet of foil having the folded leading edge; flattening the fold formed in said leading edge of the sheet; and dispensing the folded sheet of foil.

As the fold is formed in the leading edge of the strip foil, the fold lies in line of the direction of feed of the strip of foil so that as the strip advances and is flattened, the fold will not crease causing a jam nor will it unfold. Furthermore, the fold can be simply flattened by the second advancement means which also dispenses the sheets, thus simplifying the apparatus.

Preferably, the folding means comprises a folding member, the folding member being raised to block the path of said strip of foil as said strip of foil advances in its feed direction, the folding member forcing the leading edge of the strip of foil upwardly and in a direction opposite to the feed direction of the strip of foil by a predetermined amount. More preferably, the folding member extends across the path of the strip of foil, the folding member having a generally U-shaped cross section, a first arm of the U-shaped member extending beyond a second arm of the U-shaped member, the second arm being pivotable about its proximal end, the outer surface of the base of the U-shaped member comprises a projection resting on the surface of a cam such that rotation of the cam rotates the U-shaped member about its pivot such that the first arm is raised and blocks the path of the strip of foil as the strip of foil advances. In order to provide a fold of a particular dimension the first arm may remain in the path of the advancing strip of foil for a predetermined time interval forcing the leading edge of the strip of foil upwardly and in a direction opposite to the feed direction of the strip of foil by the predetermined amount.

The U-shaped member provides a simple mechanism for folding the leading edge of the foil which can be simply raised and lowered as required by travelling the U-shaped member over the outer surface of a rotating cam.

In a preferred embodiment, the cutting means comprises a blade, the blade being raised vertically on the surface of a second cam to cut the strip of foil at predetermined intervals. The timings for raising the blade can be made to provide sheets of any desired length.

The first and second advancement means may comprise a first and second pair of driver rollers commonly driven by a motor so that the first and second advancement means are synchronised to advance the strip and formed sheets at the same speed. The first and second cams may be driven by a second motor. The first and second motor can be synchronised to provide folds and cuts as required to dispense sheets of a predetermined length having a fold of a predetermined size.

BRIEF DESCRIPTION OF DRAWINGS

For a more complete understanding of the present invention, reference is now made to the following description taken in conjunction with the accompanying drawings, in which.

DETAILED DESCRIPTION OF PREFERRED EMBODIMENTS

An embodiment of the present invention will now be described in more detail with reference to FIGS. 1 to 7*d*. The dispenser 100 according to the embodiment of the present invention comprises a plastic casing 101. The casing 101 comprises a base portion 103 and a lid 105. The base portion 103 comprises a base and 4 sidewalls to form a generally rectangular box-like casing. The dispenser 100 is compact and completely portable.

Figure 1:
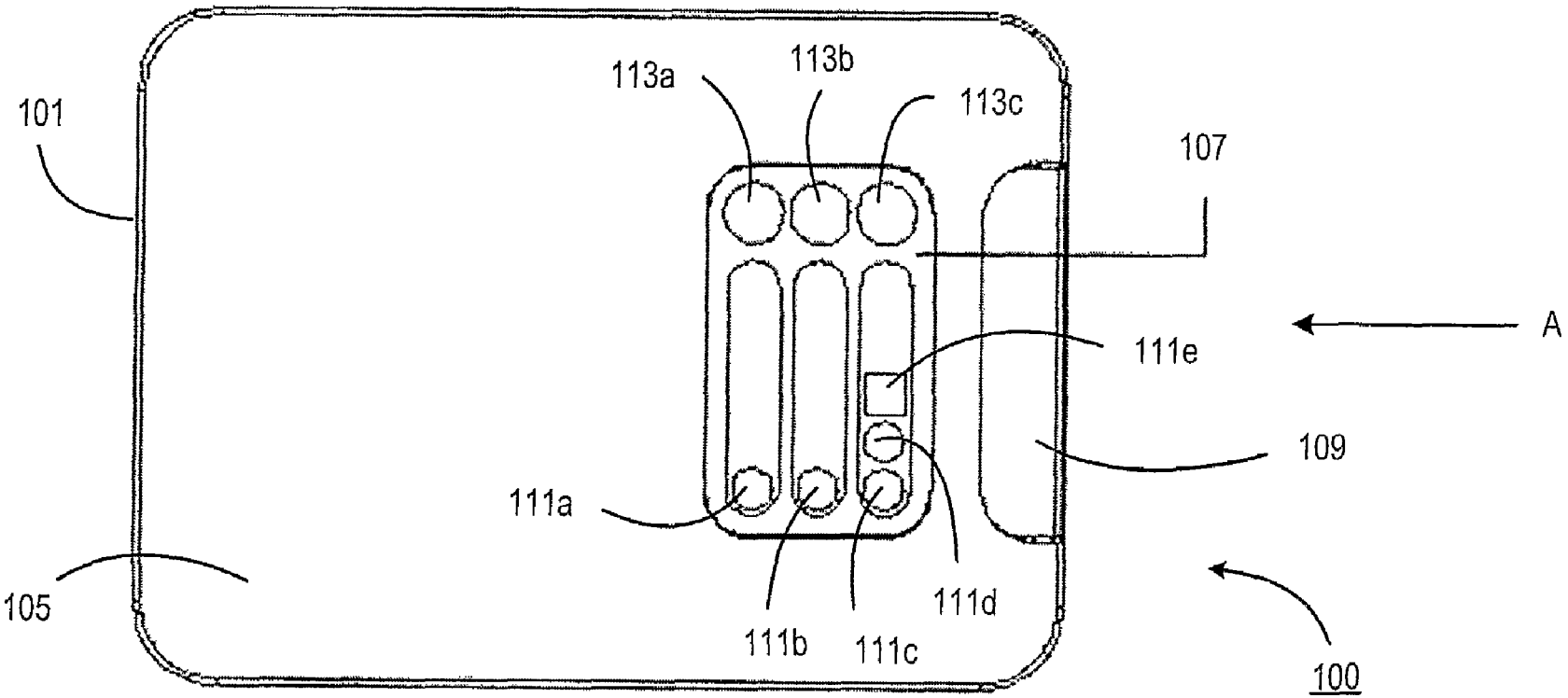
FIG. 1 is a plan view of the casing of the dispenser with the lid in its closed position according to an embodiment of the present invention.
Figure 2:
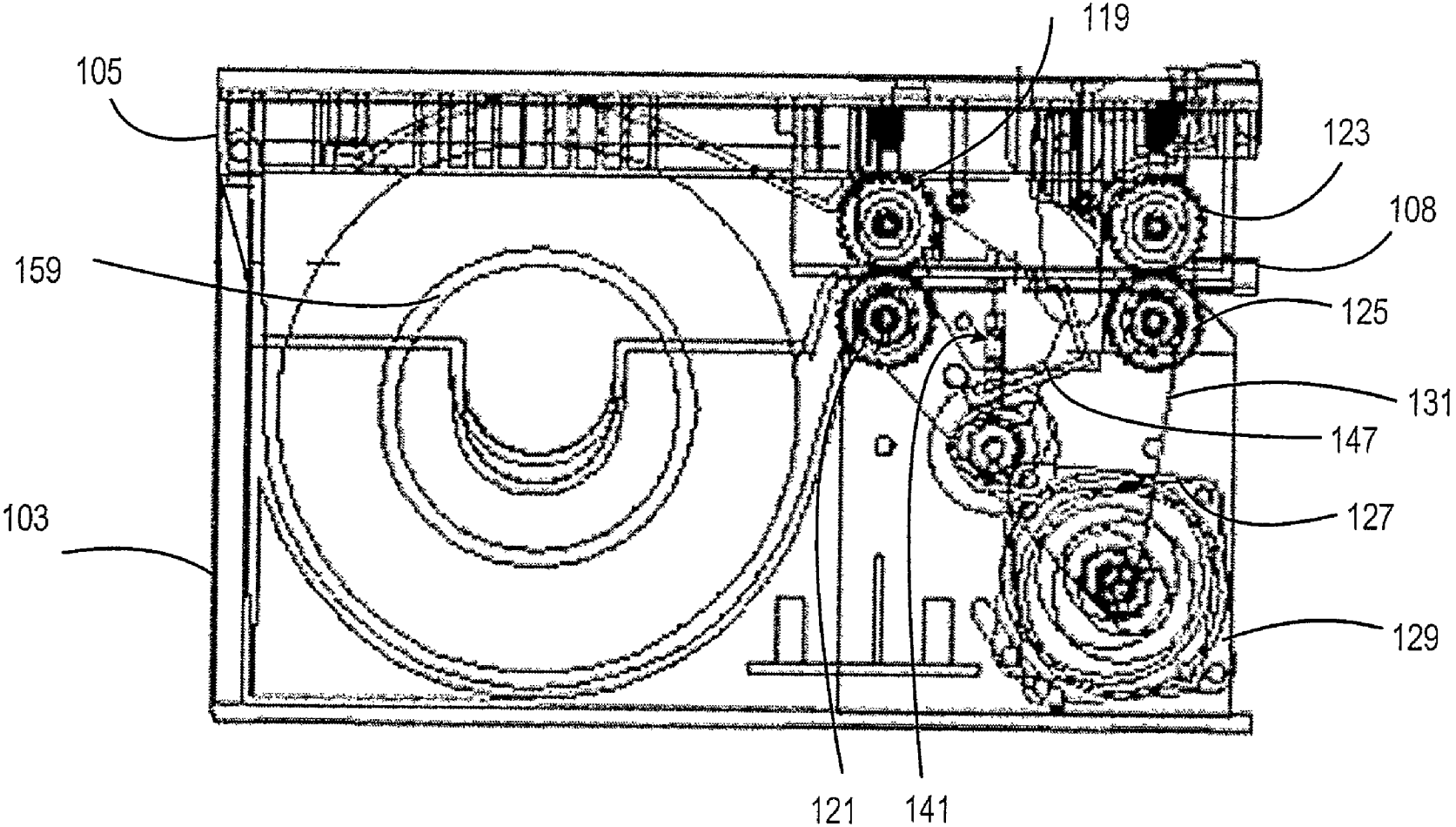
FIG. 2 is a side view of the dispenser showing the contents of the casing of the dispenser shown in FIG. 1.
Figure 3:
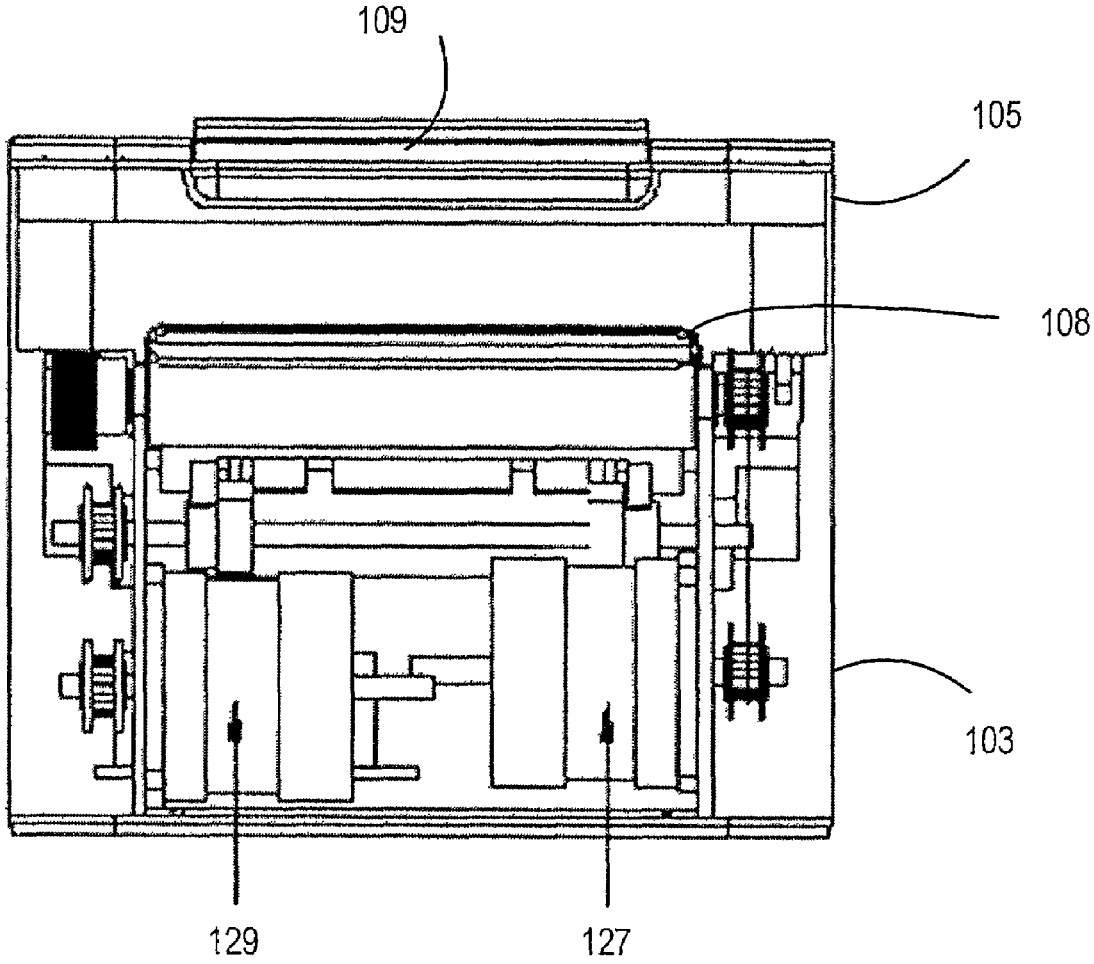
FIG. 3 is an end view of the casing in the direction of arrow A of the casing shown in FIG. 1 showing the contents of the casing.
Figure 4:
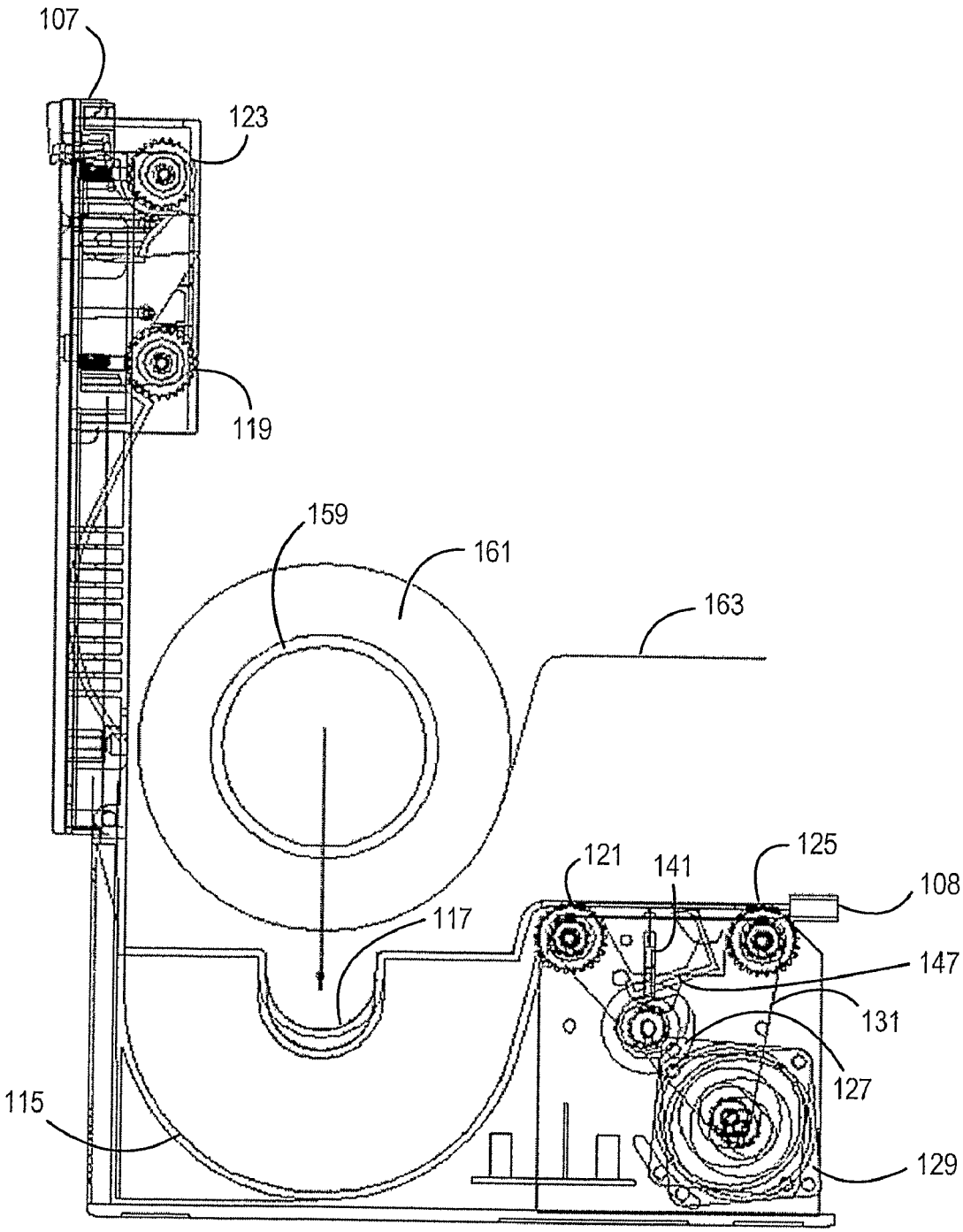
FIG. 4 is a side view of the dispenser of FIG. 1 illustrating the loading of the roll of foil into the dispenser.

The lid 105 is hingeably attached to the base portion 103 at one end thereof such that the lid can be pivoted upwardly from a closed position to an open position. The outer surface of the lid 105, as shown in FIG. 1, comprises an interface control panel 107 and a release mechanism 109. The release mechanism 109 comprises means for releasably engaging the lid 105 to the base portion 103 to seal the lid 105 to the base portion 103 when the lid 105 is in a closed position. The release mechanism 109 is disengaged to allow opening of the lid 105 as illustrated in FIG. 4. The interface control panel 107 comprises a plurality of push buttons 111*a*, 111*b*, 111*c*, 111*d* and 111*e* and a plurality of displays 113*a*, 113*b* and 113*c*.

The base portion 105 of the casing 101 comprises a semi-spherical carrier 115 into which a roll of foil is seated. The semi-spherical carrier 115 comprises thumbnail indentations 117 so that the roll 159 can be easily grasped for subsequent removal. The carrier 115 supports multiple widths of rolls of foil by means of sliding devices within the carrier 115 to centre the roll 159 within the carrier 115. The roll may be supported within the base portion 105 of the casing 101 by any alternative means such as a spindle or bung arrangement.

The casing 101 further comprises a first pair of drive rollers 119, 121 and a second pair of driver rollers 123, 125. The second pair of driver rollers 123, 125 is positioned downstream of the first pair of driver rollers 119,121. Each pair of driver rollers 119, 121 and 123, 125 comprise an upper driver roller 119 and 123 within the lid 105 of the casing 101 and lower driver roller 121 and 125 within the base portion 103 of the casing 101. Each upper driver roller 119 and 123 are positioned directly above their respective lower driver rollers 121 and 1125. The outer circumferential surface of the respective upper driver rollers 119 and 123 and lower driver rollers 121 and 125 are textured or covered with rubber etc. The base portion 103 also comprises a dispensing slot 108 downstream of the second pair of drive rollers 123 and 125. The base portion 103 comprises a first motor 127 and a second motor 129. These motors may comprise electric motors such as stepper motors or DC motors controlled by rotary shaft encoders. The motors are controlled by microprocessors (not shown here). If DC motors are used, sensors are added to detect the end of the foil. This may also provide an alarm to the user that the roll is empty.

The first motor 127 is attached to the first and second lower driver rollers 121 and 125 via a toothed drive belt 131.

The base portion 103 of the casing 101 comprises a first cam 133 and a second cam 135. The first and second cams 133 and 135 are connected to the second motor 129 via second and third drive belts 137 and 139, respectively. The base portion 103 of the casing 101 comprises a vertically reciprocating cutter 141. The lower end of the cutter 141 engages the surface of the first cam 133. The upper end of the cutter 141 comprises a blade 143. The blade slideably engages a guide 145 when the cutter 141 is in its raised position. The guide 145 is contained within the lid 105 of the casing 101. The guide 145 is formed of a sharpening stone material so that the blade is self sharpening.

The base portion 103 of the casing 101 further comprises a folding member 147. The folding member 147 extends transversely across the width of the path of the foil and has a generally U-shaped cross section. A first arm 151 of the folding member 147 extends beyond the second arm 153 of the folding member 147. The proximal end of the first arm 151 extends inwardly. The proximal end of the second arm 153 of the folding member 147 is pivotably attached to the base portion 103 of the casing 101 at the pivot point 155. The folding member 147 comprises a projection 157 having a generally triangular cross section and attached to the outer lower surface of the folding member 147 and resting on the outer surface of the second cam 135.

Operation of the dispenser 100 of the preferred embodiment of the present invention will now be described in more detail with reference to FIGS. 1 to 7*d*.

The lid 105 of the casing 101 is placed in its open position as shown in FIG. 4 by disengaging the release mechanism 109. A roll 159 of a strip of foil 161, to be dispensed, is placed in the semi-spherical carrier 115 such that the roll 159 rests upon the base of the semi-spherical carrier 115 and the strip of foil 161 unwinds from the roll 161 in an anti-clockwise direction, the free end 163 of the strip of foil 161 extending outwardly from the upper edge of the semi-spherical carrier 115. The free end 163 of the strip 161 of foil extends over the lower driver rollers 121 and 125 and out of the housing 101 via the dispensing slot 108. The lid 105 of the casing 101 is placed in its closed position until the release mechanism 109 of the lid 105 and the base portion 103 engages to seal the unit.

Figure 5:
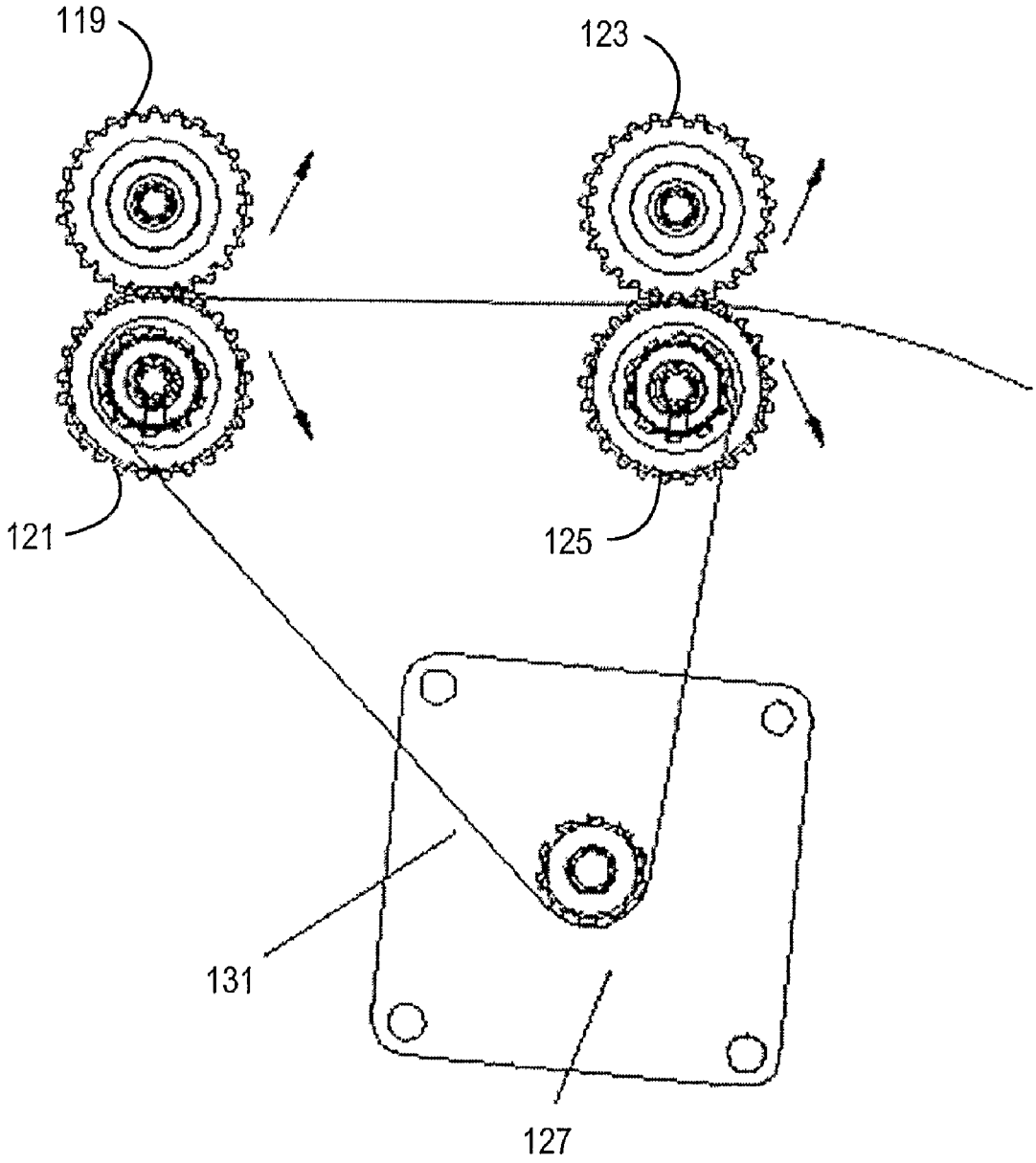
FIG. 5 is a simplified diagram of the drive rollers of the dispenser of FIG. 1.

With the lid 105 in its closed position, the free end 163 of the strip 161 of foil is positioned between the upper driver rollers 119 and 123 and the lower driver rollers 121 and 125 as shown in FIG. 5. The first and second lower driver rollers 121 and 125 are driven by the drive belt 131 and the first motor 127 upon activation of the dispenser 100 via one of the push buttons 111*a*, 111*b*, 111*c*, 111*d* and 111*e*. The first and second lower driver rollers 121 and 125 are driven to rotate in an anti-clockwise direction such that the free end 163 of the strip 161 of foil is controllably advanced from the roll 159 toward and out of the dispensing slot 108 of the casing 101 in a feed direction F. The strip 161 of foil advances in its feed direction by friction between the textured outer surfaces of the first upper and lower drive rollers and the second upper and lower drive rollers. The drive rollers are biased to provide advancement of the foil at a controlled speed without damaging or tearing the foil.

Figure 6:
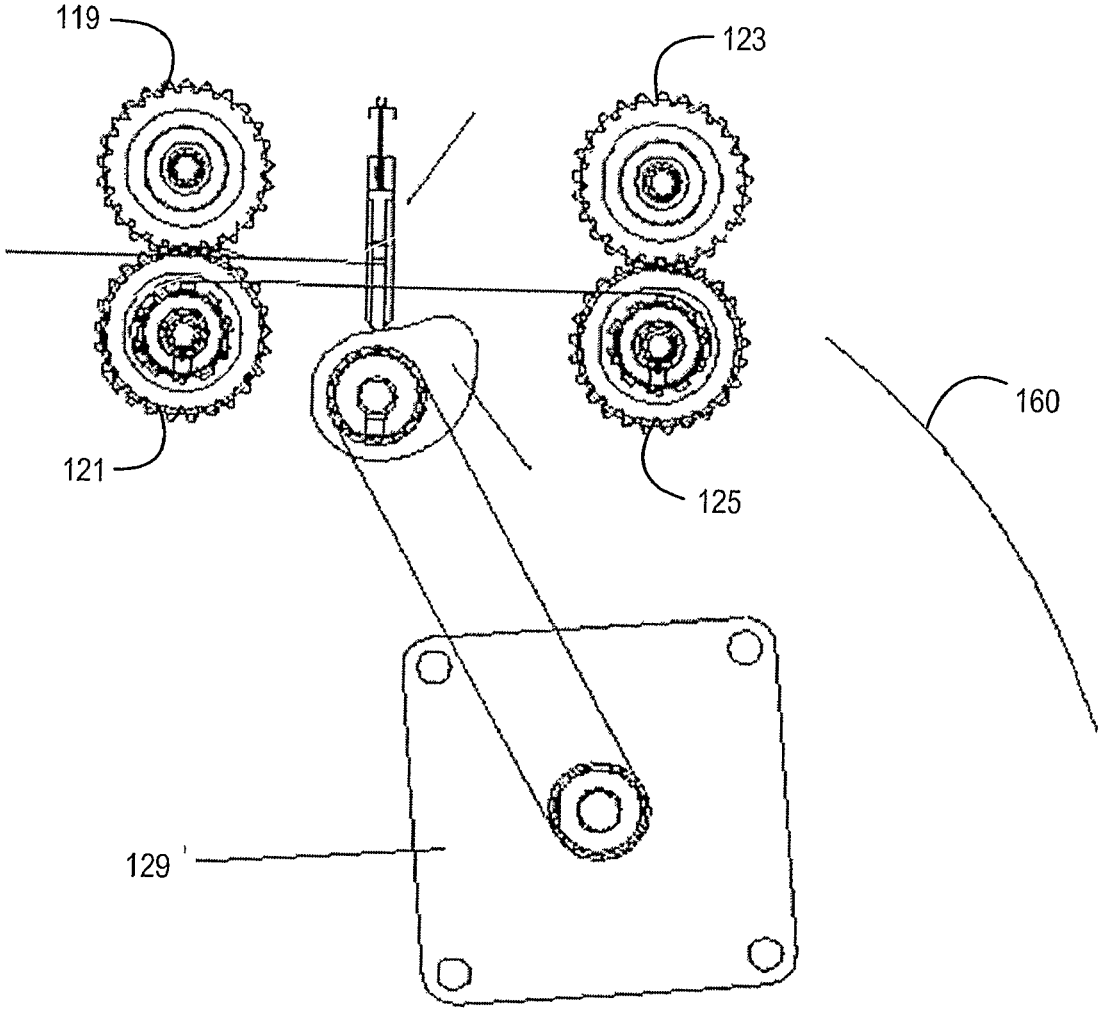
FIG. 6 is a simplified diagram of the cutting mechanism of the dispenser of FIG. 1.

A length of foil as well as size of fold required by the user is specified via the push buttons 111*a*, 111*b*, 111*c*, 111*d* and 111*e* and displayed by one of the displays 113*a*, 113*b* and 113*c*. As the specified length of strip 161 of foil passes over the driver rollers 119, 121, 123 and 125, the first cam 133 rotates via the second motor 129 and drive belt 137 causing the cutter 141 to move upwards such that the blade 143 cuts the strip 161 of foil at the required length as shown in FIG. 6. The cutter 141 then lowers as the first cam 133 continues to rotate. The edge of the subsequent length of the strip 161 passes over the lowered cutter 141.

Figure 7B:
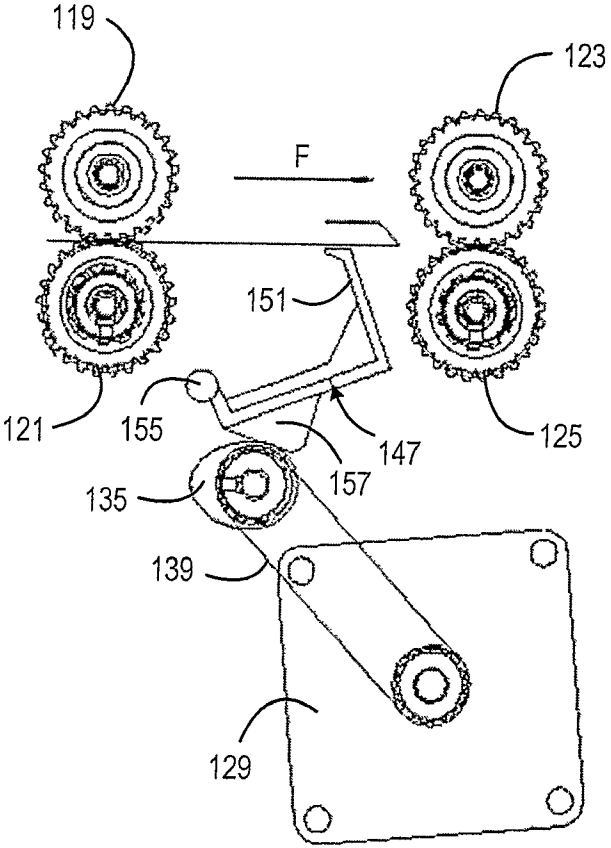
FIGS. 7*a* to 7*d* illustrate the stages of the folding mechanism of the dispenser of FIG. 1.
Figure 7A:
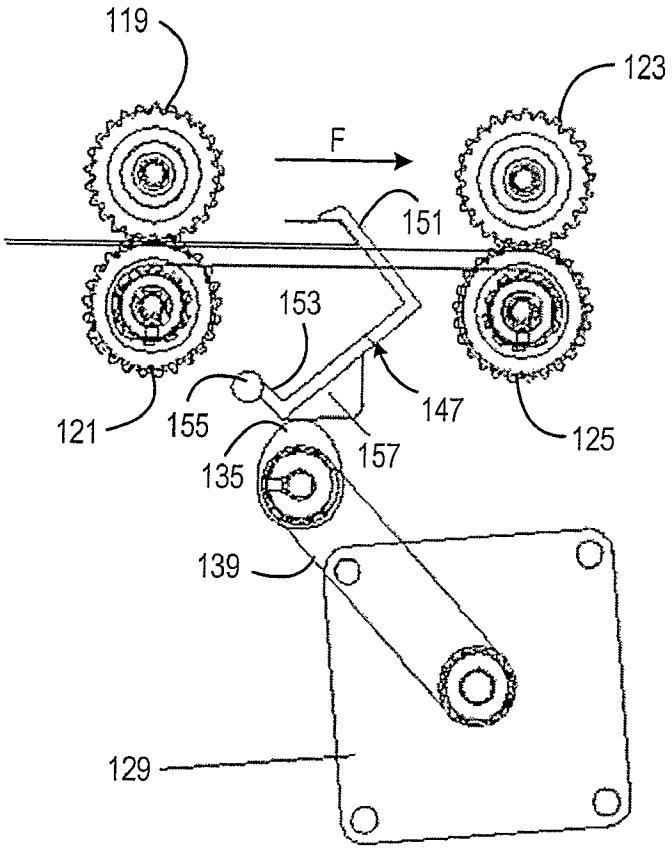
Figure 7D:
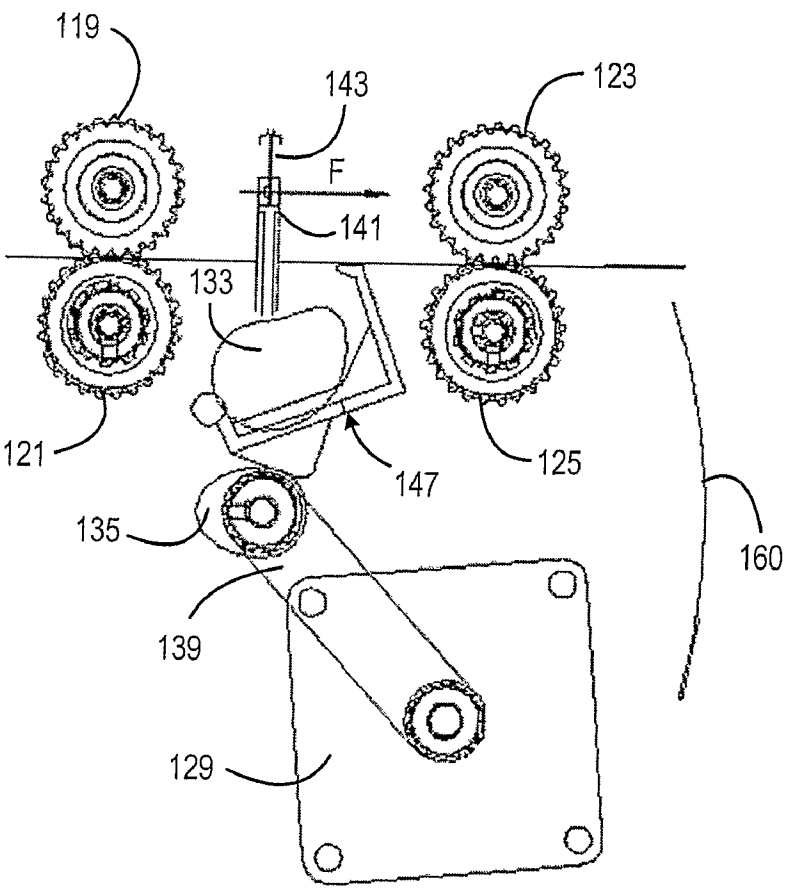
Figure 7C:
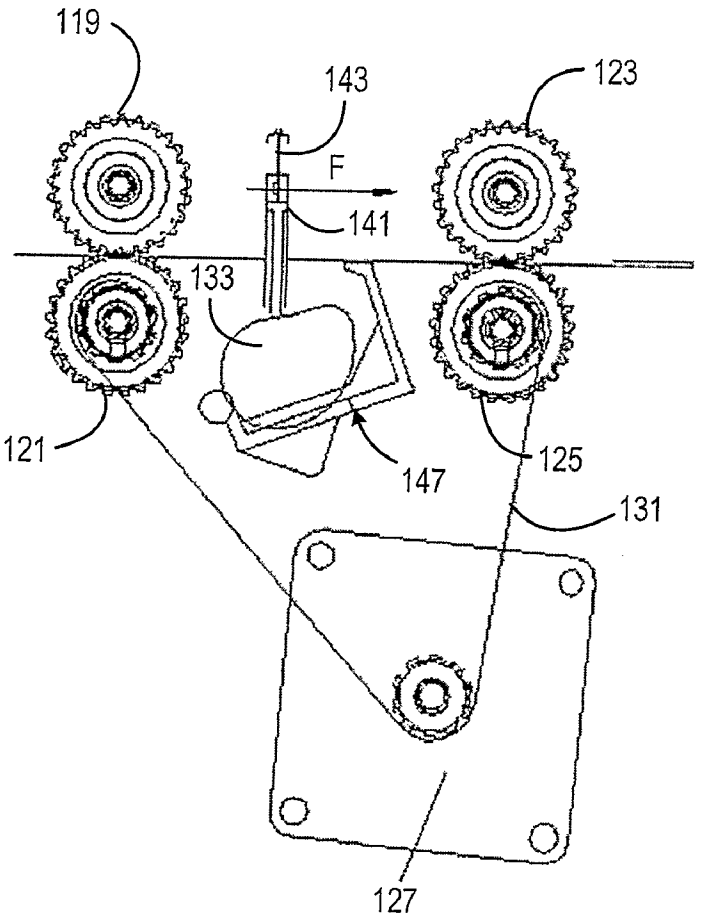

As the strip 161 of foil passes over the cutter 141 it comes into contact with the first arm 151 of the folding member 147 which has been raised by the second cam 135 as it rotates. The edge of the strip 161 of foil follows the raised first arm 151 of the folding member 147 and folds back on itself as shown in FIG. 7*a* by an amount, such as 15 mm, as set by the user via the push buttons 111*a* to 111*e*. Once the specified amount of the strip 161 of foil has folded back, the first arm 151 of the folding member 147 lowers as shown in FIG. 7*b*. The folded end of the strip 161 continues to pass over the lowered folding member 147 and the folded end is driven through the second upper and lower driver rollers 123, 125 which flattens the fold as shown in FIG. 7*c*. As the required length of foil 161 passes over the lowered cutter 141, the cutter 141 is raised and the required length of foil is cut to form a sheet 160 having a folded edge which is dispensed out of the casing 101 via the dispensing shot 108 as shown in FIG. 7*d*.

Therefore, in using the dispenser of the preferred embodiment of the present invention, the hairdresser has the dispenser unit close by and, single handed, merely presses a push button on the top of the device for a prepared sheet of foil to be dispensed.

Although a preferred embodiment of the present invention has been illustrated in the accompanying drawings and described in the foregoing description, it will be understood that the invention is not limited to the embodiment disclosed but is capable of numerous modifications without departing from the scope of the invention as set out in the following claims.

The invention claimed is:

1. Apparatus for dispensing folded sheets of foil, the apparatus comprising:

first advancement means for controllably advancing a strip of foil in a feed direction;

folding means for folding a leading edge of said strip of foil;

cutting means for cutting said strip of foil to form a sheet of foil; and second advancement means for flattening the fold formed in the leading edge of said sheet of foil and dispensing said folded sheet of foil, wherein said folding means comprises a shaped member, said shaped member being raised to block the path of said strip of foil as said strip of foil advances in its feed direction, said leading edge of said strip of foil follows said raised shaped member as said strip of foil advances forcing the said leading edge of said strip of foil upwardly and in a direction opposite to the feed direction of said strip of foil to fold back on itself by a predetermined amount.

2. Apparatus according to claim 1, wherein said member extends across the path of the strip of foil, said member having a generally U-shaped cross section a first arm of the U-shaped member extending beyond a second arm of the U-shaped member, said second arm being pivotable about its proximal end, the outer surface of the base of the U-shaped member comprises a projection resting on the surface of a first cam such that rotation of the first cam raises the U-shaped member about its pivot such that the first arm traverses and blocks the path of said strip of foil as it advances.

3. Apparatus according to claim 2, wherein the cutting means comprises a blade, said blade being raised vertically on the surface of a second cam to cut said strip of foil at predetermined intervals.

4. Apparatus according to claim 3, wherein the cutting means is raised vertically on the surface of the second cam to cut said strip of foil at predetermined intervals and wherein said first and second cams are driven by a motor.

5. Apparatus according to claim 2, wherein said first arm remains in the path of the advancing strip of foil for a predetermined time interval forcing the leading edge of said strip of foil upwardly and in a direction opposite to the feed direction of said strip of foil by a predetermined amount.

6. Apparatus according to claim 1, wherein said first and second advancement means comprises a first and second pair of driver rollers commonly driven by a motor.

7. A method for dispensing sheets of folded foil, the method comprising the steps of:

advancing a strip of foil in a feed direction;

raising a leading edge of said strip of foil by a predetermined amount as said strip of foil advances in its feed direction to fold said leading edge of said strip of foil on itself;

cutting said folded strip of foil to form a sheet of foil having said folded leading edge;

flattening said fold formed in said leading edge of said sheet; and dispensing said folded sheet of foil.

8. Apparatus for dispensing folded sheets of foil, the apparatus comprising:

first advancement means for controllably advancing a strip of foil in a feed direction;

a folding member that pivots between a first position in which a portion of the folding member blocks the pathway of the strip of foil and folds the leading edge of the strip of foil back onto strip of foil as the strip of foil advances in the feed direction, and a second position in which the folding member is pivoted out of the pathway of the strip of foil;

a device that cuts said strip of foil to form a sheet of foil; and second advancement means for flattening the fold formed in the strip of foil and dispensing said folded sheet of foil, wherein said folding member includes a first arm and a second arm that is shorter than said first arm, said folding member pivoting at a location in said second arm so that, at times when said folding member is in said first position, said first arm blocks the pathway of the strip of foil and the foil follows along said first arm as said first advancement means advances the strip of foil in the feed direction and, at times when said folding member is in said second position, said first arm is out of the pathway of the strip of foil and the strip of foil passes by said first arm.

* * * * *